US006416571B1

(12) United States Patent
Kaneko et al.

(10) Patent No.: US 6,416,571 B1
(45) Date of Patent: Jul. 9, 2002

(54) CYANIDE-FREE PYROPHOSPHORIC ACID BATH FOR USE IN COPPER-TIN ALLOY PLATING

(75) Inventors: Mitsuru Kaneko, Tokyo; Asao Hatta; Mitsuharu Kunii, both of Sakado, all of (JP)

(73) Assignee: Nihon New Chrome Co., Ltd., Tokyo (JP)

( * ) Notice: Subject to any disclaimer, the term of this patent is extended or adjusted under 35 U.S.C. 154(b) by 190 days.

(21) Appl. No.: 09/606,269

(22) Filed: Jun. 29, 2000

(30) Foreign Application Priority Data

Apr. 14, 2000 (JP) ..... 2000-114282

(51) Int. Cl.[7] ..... C23C 18/50
(52) U.S. Cl. ..... 106/1.18; 106/1.26
(58) Field of Search ..... 106/1.18, 1.26

(56) References Cited

U.S. PATENT DOCUMENTS 4,076,600 A * 2/1978 Huebner ..... 205/311
4,146,441 A * 3/1979 Willis ..... 205/314
4,526,968 A * 7/1985 Lemke et al. ..... 205/259
4,581,110 A * 4/1986 Tsuchida et al. ..... 205/245

FOREIGN PATENT DOCUMENTS

EP 1146148 A2 * 10/2001 ..... E25D/3/56
JP 10-102278 4/1998

* cited by examiner

*Primary Examiner*—Helene Klemanski
(74) *Attorney, Agent, or Firm*—Dennis G. LaPointe; Mason & Assoc., PA

(57) ABSTRACT

The present invention provides a pyrophosphoric acid bath for use in Cu—Sn alloy plating without containing a cyanic ion comprising a reaction product (A) of an amine derivative and an epihalohydrin in a 1:1 mole ratio and a cationic surfactant (B) and, when necessary, further comprising a surface tension adjusting agent (C), a bath stabilizer (D) and an N-benzylpyridinium derivative (E) as additives. According to the bath of the present invention, by changing a bath composition of copper and tin or by employing a characteristic additive, a stable film with a silver-white, gold, copper or light black color can be obtained. By increasing tin contents in the bath, the bath can be used for lead-free solder plating. The bath is safe in handling and hygienic and, moreover, has no sewage process and environmental problems since it contains neither cyanic compound nor formaldehyde derivative.

26 Claims, No Drawings

CYANIDE-FREE PYROPHOSPHORIC ACID BATH FOR USE IN COPPER-TIN ALLOY PLATING

FIELD OF INVENTION

The present invention relates to a pyrophosphoric acid bath for use in copper-tin alloy plating capable of performing copper-tin alloy plating appropriate for applications to ornamentation and lead-free solder plating without containing a cyanic ion and a copper-tin alloy coating obtained by using the cyanide-free pyrophosphoric acid bath.

DESCRIPTION OF THE RELATED ART

Nickel (Ni) plating has conventionally been widely used in plating of ornamentation. However, the Ni plating has a problem of Ni allergy which causes skin eruption or inflammation to an individual who puts on an ornament having an Ni coating so that copper-tin (Cu—Sn) alloy plating has been reviewed in recent years to take the place of the Ni plating. A Cu—Sn alloy coating has smoothness and corrosion resistance so that it has a property capable of substituting the Ni coating as a base coating for gold, silver or chromium plating.

Copper-lead (Cu—Pb) alloy plating which essentially contains lead has also conventionally been widely used as solder or solder plating. However, solder or solder plating which does not contain lead has recently been required so as to prevent a global environmental pollution.

Plating bathes for use in industrial Cu—Sn alloy plating are mostly those containing a cyanic ion such as a cyanide-stannic acid bath, tin pyrophosphate-copper cyanide bath and the like. Due to a severe sewage treatment regulation, treatment of waste water from those bathes is costly. There is also a problem from the standpoint of an operation in a safe environment. Therefore, a Cu—Sn alloy plating bath without containing a cyanic ion (hereinafter referred to simply as "cyanide-free") is required.

As a cyanide-free Cu—Sn alloy plating bath, a pyrophosphoric acid bath has conventionally been known. A pyrophosphoric acid plating is performed by energizing a bath containing copper pyrophosphate, stannous pyrophosphate, a complexing agent (for example, an alkali metal salt of pyrophosphoric acid) and other additives; however, since there is no appropriate brightener suitable for the pyrophosphoric acid bath, a coating to be obtained has neither silver-white gloss nor stable color tone, namely, is not fully satisfactory for ornamentation. Furthermore, the pyrophosphoric acid bath for use in Cu—Sn alloy plating has a narrow optimum current density range so that the metal alloy tends to be deposited in a spongy state; thus, the cyanide-free bath which is industrially applicable has not been put to practical use.

Therefore, the applicant of the present invention has previously proposed in Japanese Laid-Open Patent Publication (JP-A) No. 10-102278 a pyrophosphoric acid bath for use in Cu—Sn alloy plating which contains a reaction product of an amine derivative and an epihalohydrin in a 1:1 weight ratio and an aldehyde derivative (formaldehyde, paraformaldehyde or metaformaldehyde) and, when necessary, further contains a surface tension adjusting agent as a cyanide-free pyrophosphoric acid bath by which Cu—Sn alloy plating for ornamentation can safely be performed in an industrial scale in place of Ni plating. According to the cyanide-free pyrophosphoric acid bath described above, color tones of the deposited film can easily be changed between from silver-white to copper colored and also a glossy, beautiful coating having a stable color tone and a film can be obtained. However, since an aldehyde derivative used as a gloss auxiliary has a hygienic problem in an operational environment and a ratio of tin contents can not be raised more than about 60% at the maximum, the proposed bath can not be used for the solder plating.

SUMMARY OF THE INVENTION

Therefore, an object of the present invention is to solve the above-described problems of a cyanide-free pyrophosphoric acid bath which contains a reaction product of an amine derivative and an epihalohydrin and an aldehyde derivative to be used for substituting Ni plating and to provide a cyanide-free pyrophosphoric acid bath for use in Cu—Sn alloy plating capable of performing lead-free solder plating.

Under the above circumstances, the present inventors have conducted an intensive study and found that not only the above-described problems are solved by employing a cationic surfactant in place of the aldehyde derivative as an additive described in JP-A No. 10-102278, but also, by adjusting a ratio of Cu ion and Sn ion contents of the said bath, both color tone and film become stable, the film can be obtained the color of which is changeable between from glossy, beautiful silver-white to copper colored and further to light black and the present invention can be used as lead-free solder plating since the tin content can substantially be increased in the alloy coating. Thus, the present invention has been accomplished on the basis of this finding.

Namely, the present invention provides a pyrophosphoric acid bath for use in Cu—Sn alloy plating and a Cu—Sn alloy coating as follows:

1) A pyrophosphoric acid bath for use in Cu—Sn alloy plating without containing a cyanic ion, comprising a reaction product (A) of an amine derivative and an epihalohydrin in a 1:1 mole ratio and a cationic surfactant (B) as additives.
2) The pyrophosphoric acid bath for use in Cu—Sn alloy plating described in 1) above, further comprising a surface tension adjusting agent (C).
3) The pyrophosphoric acid bath for use in Cu—Sn alloy plating described in 1) above, further comprising a bath stabilizer (D).
4) The pyrophosphoric acid bath for use in Cu—Sn alloy plating described in any one of 1) to 3) above, further comprising an N-benzylpyridinium derivative (E).
5) The pyrophosphoric acid bath for use in Cu—Sn alloy plating described in 1) above, wherein the reaction product (A) of an amine derivative and an epihalohydrin in a 1:1 mole ratio is a reaction product of at least one amine derivative selected from the group consisting of ammonium, ethylenediamine, diethylenetriamine, diethylenediamine (piperazine), n-propylamine, 1,2-propanediamine, 1,3-propanediamine, 1-(2-aminoethyl) piperazine, 3-diethylaminopropylamine, dimethylamine, hexamethylenetetramine, tetraethylenepentamine, triethanolamine, hexamethylenediamine and isopropanolamine, and epichlorohydrin in a 1 to 1 mole ratio.
6) The pyrophosphoric acid bath for use in Cu—Sn alloy plating described in 1) above, wherein the cationic surfactant (B) is selected from the group consisting of betaine-type surfactants and quaternary ammonium salt-type surfactants.
7) The pyrophosphoric acid bath for use in Cu—Sn alloy plating described in 2) above, wherein the surface tension adjusting agent (C) is selected from the group consisting of gelatin, gum arabic, polyvinylalcohol, polyethyleneglycol, polypropyleneglycol and acetyleneglycol.

8) The pyrophosphoric acid bath for use in Cu—Sn alloy plating described in 3) above, wherein the bath stabilizer (D) is selected from the group consisting of organic sulfonic acids and the salts thereof.

9) The pyrophosphoric acid bath for use in Cu—Sn alloy plating described in 4) above, wherein N-benzylpyridinium derivative (E) is a reaction product of a pyridine derivative and benzyl chloride in a 1:1 mole ratio.

10) A Cu—Sn alloy coating which can be obtained by using the pyrophosphoric acid bath for use in Cu—Sn alloy plating described in any one of 1) to 9) above.

DETAILED DESCRIPTION

The present invention will be described in detail below.

A pyrophosophoric acid bath according to the present invention is prepared by compounding the above-described components (A) and (B) and, when necessary, further components (C), (D) and (E) as additives into a known fundamental bath composition of a pyrophosphoric acid bath for use in Cu—Sn alloy plating.

The fundamental composition of the pyrophosphoric acid bath contains a Cu ion, an Sn ion and an alkali metal salt (potassium salt or sodium salt) of pyrophosphoric acid for forming a water-soluble complex salt. As a source of the Cu ion, copper pyrophosphate can favorably be utilized; as a source of the Sn ion, stannous pyrophosphate, stannous chloride, stannous sulfate or the like is exemplified and stannous pyrophosphate is preferable.

A content of Cu ion is 0.1 to 80 g/l and preferably 0.5 to 72 g/l as copper pyrophosphate; a content of Sn ion is 2 to 60 g/l and preferably 10 to 45 g/l as stannous pyrophosphate. When concentrations of copper pyrophosphate and stannous pyrophosphate come out of the above-described respective ranges, a composition of the deposited alloy fluctuates whereupon color tone can not be controlled.

An alkali metal salt of pyrophosphoric acid is compounded such that the ratio of "$P_2O_7$" to "Sn+Cu" (referred to as "p ratio") is 4 to 30 and preferably 4.5 to 26.5. Specifically, it is about 50 to 500 g/l and preferably about 150 to 450 g/l as potassium pyrophosphate. When the p ratio is lower than the above-described range (namely, the amount of the alkali metal salt of pyrophosphate is smaller), the alkali metal salt forms a water-insoluble complex salt with copper or tin whereby a normal coating can not be obtained. In contrast, when the p ratio exceeds the above-described range (namely, the amount of the alkali metal salt of pyrophosphate is larger), current efficiency is decreased so that such a p ratio is impractical.

The fundamental composition of the pyrophosphoric acid bath is shown below.

TABLE 1

| Components | Ranges of contents* |
|---|---|
| Stannous pyrophosphate | 2–60 (10–45) g/l |
| as Sn ions | 1.2–34.6 (5.8–25.9) g/l |
| Copper pyrophosphate | 0.1–80 (0.5–72) g/l |
| as Cu ions | 0.04–28.6 (0.18–25.8) g/l |
| Potassium pyrophosphate | 50–500 (150–450) g/l |
| ρ ratio | 4–30 (4.5–26.5) |

*The values in ( ) are preferred ranges of contents.

Among additives to be used in the present invention, the additive (A) (reaction product of an amine derivative and an epihalohydrin in a 1:1 mole ratio) works as a brightener.

Examples of amine derivatives include ammonium, ethylenediamine, diethylenetriamine, diethylenediamine (piperazine), n-propylamine, 1,2-propanediamine, 1,3-propanediamine, 1-(2-aminoethyl)piperazine, 3-diethylaminopropylamine, dimethylamine, hexamethylenetetramine, tetraethylenepentamine, triethanolamine, hexamethylenediamine, isopropanolamine and the like. Any one of them may be used independently or otherwise two or more of them may simultaneously be used in combination. Epihalohydrins include, for example, epichlorohydrin. As a preferred reaction product of amine derivative and epihalohydrin in a 1:1 mole ratio, exemplified is a reaction product of diethylenediamine (piperazine) or 1-(2-aminoethyl)piperazine and epichlorohydrin.

Such reaction products can be obtained by mixing an epihalohydrin to an aqueous solution of amine derivative in a 1:1 mole ratio and then by stirring the thus prepared mixture. The reaction is exothermal so that epihalohydrin is added in a plurality of times in order to prevent the temperature of the solution from being elevated too high. The reacted solution thus obtained can be purified by removing solvent and the like; however, the reacted solution per se may be added into the bath.

The amount of the additive (A) (brightener) is 0.13 to 1.5 g/l and preferably 0.35 to 0.72 g/l. If the amount of the additive (A) is less than the above range, alloy deposition tends to be spongy; in contrast, if the amount exceeds the above range, adhesiveness of a coating becomes poor and also discoloration resistance or stability in color tone thereof is deteriorated though gloss thereof is increased.

Examples of the cationic surfactants used as the additive (B) include betaine-type surfactants and quaternary ammonium salt-type surfactants.

Specific examples of the betaine-type surfactants include perfluoroalkylbetaine, laurylbetaine and the like. Specific examples of the quaternary ammonium salt-type surfactants include perfluoroalkyltrimethyl ammonium salts, alkylbenzyldimethylammonium chloride and the like.

The amount of the additive (B) is 0.01 to 0.1 g/l and preferably 0.05 to 0.08 g/l. If the amount of the additive (B) is less than the above range, the gloss of the coating becomes uneven; in contrast, if the amount exceeds the above range, a crack will be generated in a coating film.

According to the present invention, a glossy, beautiful coating can be obtained by adding the above-described additives (A) and (B); and, moreover, separation of gas from the coating becomes better and both durability and corrosion resistance of the coating are enhanced by adding the additive (C) (surface tension adjusting agent).

Various types of polymers and colloids can be used as the surface tension adjusting agent (C). They include, for example, gelatin, gum arabic, polyvinylalcohol, polyethyleneglycol, polypropyleneglycol, acetyleneglycol and the like. Among them, acetyleneglycol is preferable.

The additive (D) (bath stabilizer) prevents precipitation of copper powders in a solution owing to Cu reduction as shown in the following reaction:

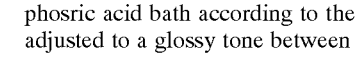

$$Sn^{2+}+Cu^{2+}\rightarrow Sn^{4+}+Cu$$

and contributes to solve the problem of instability of a Sn ion which is a primal defect of the pyrophosphoric acid bath for use in Cu—Sn alloy plating.

As the additive (D), organic sulfonic acids and the salts thereof are exemplified. Among them, alkanolsulfonic acid, cresol sulfonic acid, phenol sulfonic acid, sulfosalicylic acid, methane sulfonic acid and the like are preferable.

Color tone of the coating film derived from the pyrophosphosric acid bath according to the present invention can be adjusted to a glossy tone between from silver-white to gold colored and further to copper colored by changing the ratio of Sn ion and Cu ion contents in the bath.

In other words, when ion concentration ratio of Sn and Cu in the bath composition comes to be 3 to 5:1, namely, Sn:Cu=3 to 5:1, the ratio of the Sn content in the alloy composition of the coating film exceeds 50% to produce a tone of silver white color; when the ratio of Sn and Cu comes to be about 2:1 by increasing the ratio of copper content in the bath composition, namely, Sn:Cu=about 2:1, the ratio of the Sn content in the alloy composition of the coating film becomes about 50% to produce a tone of gold color; and when the ratio of Sn and Cu comes to be about 1:1 by further increasing the ratio of copper content in the bath composition, namely, Sn:Cu=about 1:1, the ratio of the Sn content in the alloy composition of coating film becomes about 20% to produce a tone of copper color. On the contrary, when the ion concentration ratio of Sn and Cu in the bath composition comes to be about 15:1 by increasing the ratio of tin content, namely, Sn:Cu=about 15:1, the ratio of Sn content in the alloy composition of the coating film reaches about 99% to allow the bath to be used for lead-free solder plating.

Moreover, by using an N-benzylpyridinium derivative (E) as an additive, a color tone can be adjusted to be glossy, light black. The term "N-benzylpyridinium derivatives" as used herein refers to a reaction product of a pyridine derivative such as pyridine, picoline, nicotinic acid or the like and benzyl chloride in a 1:1 mole ratio. When the additive (E) is mixed, the mixing ratio thereof is preferably about 0.1 to 0.2 g/l. In addition to the above-described additives, various types of chemicals which have ordinarily been used in the field of plating technology are used in the plating bath according to the present invention within respective ranges of the contents thereof that do not impair characteristics of the present invention.

In the plating bath according to the present invention, pH is in a weak alkaline range of 7 to 10 and preferably 7.2 to 9. If the pH is less than 7, a pyrophosphate is changed into an orthophosphate which gives an adverse effect such as impairing a uniform electrodeposition property or the like and also causes the coating to be obtained to have a rough surface; hence a normal coating can not be obtained. In contrast, if the pH exceeds 10, a current density range becomes narrower so that the uniform electrodeposition property and current efficiency are decreased. In this case, moreover, the bath stability is adversely affected.

A plating operation is performed by an electroplating method using the above-described pyrophosphoric acid bath. Temperature of the bath is 20 to 50° C. and preferably 25 to 30° C. If the temperature exceeds 50° C., a pyrophosphate is changed into an orthophosphate whereupon a normal coating can not be obtained as described above. In contrast, if the temperature is lower than 20° C., the current efficiency is decreased. Moreover, the current density is 0.05 to 10 A/dm$^2$ and preferably about 0.1 to 8.0 A/dm$^2$. The plating operation can be performed by a known method such as a barrel plating method or the like.

BEST MODE FOR CARRYING OUT THE INVENTION

The following examples are given to illustrate the present invention and should not be interpreted as limiting it in any way. Unless otherwise stated, all parts and percentages are given in weight.

The additives herein employed are described below.

(A) A brightener (reaction product of an amine derivative and an epihalohydrin in a 1:1 mole ratio)

300 ml of water and 1 mol (86 g) of piperazine were added to a sealable vessel equipped with a thermometer, a coiled condenser and a stirrer, stirred and dissolved to prepare a solution. Then, the temperature of the solution was brought to 40° C. Then, 1 mol (92 g) of epichlorohydrin was added to the solution divided in ten times while being stirred. During the addition step, the temperature of the solution went up with reaction heat; however, time intervals between additions of epichlorohydrin were adjusted such that the temperature of the solution did not exceed 80° C. at the maximum. After the total quantity of epichlorohydrin was added, the solution was stirred for one hour while keeping it at 80° C. Thereafter, the solution was cooled down to a room temperature without being forced. Finally the total quantity of the solution was adjusted to be one liter.

(B) A Cationic Surfactant

An ammonium salt of perfluoroalkyltrimethyl (tradename: Surflon S-121 of Asahi Glass Co. Ltd.).

(C) A Surface Tension Adjusting Agent

Aceryleneglycol (tradename: Surfynol 465 of Nisshin Chemical Industries, Ltd.).

(D) A Bath Stabilizer

Methane sulfonic acid, phenol sulfonic acid or sulfosalicylic acid.

(E) N-benzylpyridinium Derivative 300 ml of water was added to a sealable vessel equipped with a thermometer, a coiled condenser and a stirrer, and 1.5 mol (60 g) of sodium hydroxide was added to the water and dissolved to prepare a solution. Further, 1 mol (123 g) of nicotinic acid was dissolved in the solution. Then, 1 mol (126 g) of benzyl chloride was added in the solution divided in ten times while keeping it at 50° C. During the addition step, the temperature of the solution went up with reaction heat; however, intervals between additions of benzyl chloride were adjusted such that the temperature of the solution did not exceed 80° C. at the maximum. After the total quantity of benzyl chloride was added, the solution was stirred for one hour while keeping it at 80° C. Thereafter, the solution was cooled down to the room temperature without being forced. Finally the total quantity of the solution was adjusted to be one liter whereupon an aqueous solution of 1M (molar) N-benzylnicotinium hydrochloride was obtained.

EXAMPLE 1

1.5 liter of a plating bath having the composition described below was prepared. Then, a plating operation was performed in a mini-barrel by energizing for 15 to 20 minutes under conditions that the temperature of the bath was 25 to 30° C. and the current density was 0.5 A/dm$^2$ on 30 pieces (3 dm$^3$) of brass buttons previously subjected to conventional pretreatments, namely, alkali degreasing, rinsing, pickling and then rinsing.

TABLE 2

| | |
|---|---|
| Stannous pyrophosphate (Sn2P2O7) | 23 g/l |
| Copper pyrophosphate (CU2P2O7) | 7.5 g/l |
| Potassium pyrophosphate (K4P2O7) | 160 g/l |
| (A) Brightener | 2 ml/l |
| (B) Catiotic surfactant | 0.5 g/l |
| (C) Surface tension adjusting agent | 0.04 g/l |
| (D) Bath stabilizer (methane sulfonic acid) | 50 g/l |
| ρ ratio | 10.79 |
| pH | 8.17 |
| Current density | 0.5 A/dm$^2$ |

The thus obtained coating layer was a glossy, silver-white, beautiful film. Chemical analysis of the alloy composition of the coating layer found that Cu:Sn=55:45 by weight.

EXAMPLE 2

A plating process was performed using the similar method to that described in Example 1 except for the bath composition and conditions as shown on Table 3 below. The plating process was performed under condition that the current density was 3.0 A/dm$^2$.

TABLE 3

| | |
|---|---|
| Stannous pyrophosphate (Sn2P2O7) | 18 g/l |
| Copper pyrophosphate (Cu2P2O7) | 30 g/l |
| Potassium pyrophosphate (K4P2O7) | 250 g/l |
| (A) Brightener | 4 ml/l |
| (B) Catiotic surfactant | 0.5 g/l |
| (C) Surface tension adjusting agent | 0.04 g/l |
| (D) Bath stabilizer (phenol sulfonic acid) | 90 g/l |
| ρ ratio | 8.77 |
| pH | 8.10 |
| Current density | 3.0 A/dm$^2$ |

The thus obtained coating layer was a glossy, copper-colored, beautiful film. Chemical analysis of the alloy composition of the coating layer found that Cu:Sn=87:13 by weight.

EXAMPLE 3

A plating process was performed using the similar method to that described in Example 1 except for the bath composition and conditions as shown on Table 4 below. The plating process was performed under condition that the current density was 1.5 A/dm$^2$.

TABLE 4

| | |
|---|---|
| Stannous pyrophosphate (Sn2P2O7) | 18 g/l |
| Copper pyrophosphate (CU2P2O7) | 15 g/l |
| Potassium pyrophosphate (K4P2O7) | 200 g/l |
| (A) Brightener | 4 ml/l |
| (B) Catiotic surfactant | 0.5 g/l |
| (C) Surface tension adjusting agent | 0.04 g/l |
| (D) Bath stabilizer (sulfosalicylic acid) | 75 g/l |
| ρ ratio | 10.49 |
| pH | 7.76 |
| Current density | 1.5 A/dm$^2$ |

The thus obtained coating layer was a glossy, gold-colored, beautiful film. Chemical analysis of the alloy composition of the coating layer found that Cu:Sn=70:30 by weight.

EXAMPLE 4

A plating process was performed using the similar method to that described in Example 1 except for the bath composition and conditions as shown on Table 5 below. The plating process was performed under condition that the current density was 2.5 A/dm$^2$.

TABLE 5

| | |
|---|---|
| Stannous pyrophosphate (Sn2P2O7) | 15 g/l |
| Copper pyrophosphate (CU2P2O7) | 1 g/l |
| Potassium pyrophosphate (K4P2O7) | 300 g/l |
| (A) Brightener | 1 ml/l |
| (B) Catiotic surfactant | 0.5 g/l |
| (C) Surface tension adjusting agent | 0.04 g/l |
| (D) Bath stabilizer (methane sulfonic acid) | 50 g/l |
| ρ ratio | 18.34 |
| pH | 8.01 |
| Current density | 0.2 A/dm$^2$ |

The thus obtained coating layer (deposited material) was a glossy, silver-white, beautiful film. Chemical analysis of the alloy composition of the coating layer found that Cu:Sn=1:99 by weight. The film had a good solder wettability.

EXAMPLE 5

A plating process was performed using the similar method to that described in Example 1 except for the bath composition and conditions as shown on Table 6 below.

TABLE 6

| | |
|---|---|
| Stannous pyrophosphate (Sn2P2O7) | 23 g/l |
| Copper pyrophosphate (CU2P2O7) | 7.5 g/l |
| Potassium pyrophosphate (K4P2O7) | 160 g/l |
| (A) Brightener | 4 ml/l |
| (B) Catiotic surfactant | 0.5 g/l |
| (C) Surface tension adjusting agent | 0.04 g/l |
| (D) Bath stabilizer (methane sulfonic acid) | 50 g/l |
| (E) N-benzylnicotinium hydrochloride | 1–2 ml/l |
| ρ ratio | 6.18 |
| pH | 8.10 |
| Current density | 0.5 A/dm$^2$ |

The thus obtained coating layer (deposited material) was a glossy, black, beautiful film. Chemical analysis of the alloy composition of the coating layer found that Cu:Sn=41:59 by weight.

What is claimed is:

1. A pyrophosphoric acid bath for use in Cu—Sn alloy plating without containing a cyanic ion, comprising:

a reaction product of an amine derivative and an epihalohydrin in a 1:1 mole ratio; and a cationic surfactant.

2. The pyrophosphoric acid bath for use in Cu—Sn alloy plating according to claim 1, further comprising a surface tension adjusting agent.

3. The pyrophosphoric acid bath for use in Cu—Sn alloy plating according to claim 1, further comprising a bath stabilizer.

4. The pyrophosphoric acid bath for use in Cu—Sn alloy plating according to claim 1, further comprising an N-benzylpyridinium derivative.

5. The pyrophosphoric acid bath for use in Cu—Sn alloy plating according to claim 1, wherein the reaction product is a product of a reaction in a 1:1 mole ratio of at least one amine derivative selected from the group consisting of ammonium, ethylenediamine, diethylenetriamine, diethylenediamine (piperazine), n-propylamine, 1,2-propanediamine, 1,3-propanediamine, 1-(2-aminoethyl)piperazine, 3-diethylaminopropylamine, dimethylamine, hexamethylenetetramine, tetraethylenepentamine, triethanolamine, hexamethylenediamine and isopropanolamine, and epichlorohydrin.

6. The pyrophosphoric acid bath for use in Cu—Sn alloy plating according to claim 1, wherein the cationic surfactant is selected from the group consisting of betaine-type surfactants and quaternary ammonium salt surfactants.

7. The pyrophosphoric acid bath for use in Cu—Sn alloy plating according to claim 2, wherein the surface tension adjusting agent is selected from the group consisting of gelatin, gum arabic, polyvinylalcohol, polyethyleneglycol, polypropyleneglycol and acetyleneglycol.

8. The pyrophosphoric acid bath for use in Cu—Sn alloy plating according to claim 3, wherein the bath stabilizer is selected from the group consisting of organic sulfonic acids and the salts thereof.

9. The pyrophosphoric acid bath for use in Cu—Sn alloy plating according to claim 4, wherein N-benzylpyridinium derivative is a reaction product of a pyridine derivative and benzyl chloride in a 1:1 mole ratio.

10. A Cu—Sn alloy coating which can be obtained by a Cu—Sn plating method, wherein a pyrophosphoric acid bath according to claim 1 is provided.

11. The pyrophosphoric acid bath for use in Cu—Sn alloy plating according to claim 2, further comprising an N-benzylpyridinium derivative.

12. The pyrophosphoric acid bath for use in Cu—Sn alloy plating according to claim 3, further comprising an N-benzylpyridinium derivative.

13. The pyrophosphoric acid bath for use in Cu—Sn alloy plating according to claim 11, wherein N-benzylpyridinium derivative is a reaction product of a pyridine derivative and benzyl chloride in a 1:1 mole ratio.

14. The pyrophosphoric acid bath for use in Cu—Sn alloy plating according to claim 12, wherein N-benzylpyridinium derivative is a reaction product of a pyridine derivative and benzyl chloride in a 1:1 mole ratio.

15. A Cu—Sn alloy coating which can be obtained by a Cu—Sn plating method, wherein a pyrophosphoric acid bath according to claim 2 is provided.

16. A Cu—Sn alloy coating which can be obtained by a Cu—Sn plating method, wherein a pyrophosphoric acid bath according to claim 3 is provided.

17. A Cu—Sn alloy coating which can be obtained by a Cu—Sn plating method, wherein a pyrophosphoric acid bath according to claim 4 is provided.

18. A Cu—Sn alloy coating which can be obtained by a Cu—Sn plating method, wherein a pyrophosphoric acid bath according to claim 5 is provided.

19. A Cu—Sn alloy coating which can be obtained by a Cu—Sn plating method, wherein a pyrophosphoric acid bath according to claim 6 is provided.

20. A Cu—Sn alloy coating which can be obtained by a Cu—Sn plating method, wherein a pyrophosphoric acid bath according to claim 7 is provided.

21. A Cu—Sn alloy coating which can be obtained by a Cu—Sn plating method, wherein a pyrophosphoric acid bath according to claim 8 is provided.

22. A Cu—Sn alloy coating which can be obtained by a Cu—Sn plating method, wherein a pyrophosphoric acid bath according to claim 9 is provided.

23. A Cu—Sn alloy coating which can be obtained by a Cu—Sn plating method, wherein a pyrophosphoric acid bath according to claim 11 is provided.

24. A Cu—Sn alloy coating which can be obtained by a Cu—Sn plating method, wherein a pyrophosphoric acid bath according to claim 12 is provided.

25. A Cu—Sn alloy coating which can be obtained by a Cu—Sn plating method, wherein a pyrophosphoric acid bath according to claim 13 is provided.

26. A Cu—Sn alloy coating which can be obtained by a Cu—Sn plating method, wherein a pyrophosphoric acid bath according to claim 14 is provided.

* * * * *

UNITED STATES PATENT AND TRADEMARK OFFICE

CERTIFICATE OF CORRECTION

PATENT NO. : 6,416,571 B1
DATED : July 9, 2002
INVENTOR(S) : Mitsuru Kaneko et al.

It is certified that error appears in the above-identified patent and that said Letters Patent is hereby corrected as shown below:

Title page,
Item [75], Inventors, replace “both of Sakado, all of (JP)” with -- both of Saitama, all of (JP) --.

Column 9,
Line 8, “betaine-type surfactants” with -- betaine surfactants --.

Signed and Sealed this

Fifth Day of November, 2002

*Attest:*

*Attesting Officer*

JAMES E. ROGAN
*Director of the United States Patent and Trademark Office*